United States Patent [19]

Wright et al.

[11] 4,137,514

[45] Jan. 30, 1979

[54] CONTROL MECHANISM

[75] Inventors: Lonnie C. Wright; David L. Billings, both of Louisville, Ky.

[73] Assignee: General Electric Company, Louisville, Ky.

[21] Appl. No.: 841,164

[22] Filed: Oct. 11, 1977

[51] Int. Cl.[2] ..... H01F 7/08

[52] U.S. Cl. ..... 335/220; 74/479; 335/189; 335/266; 400/163.2

[58] Field of Search ..... 74/479; 335/189, 190, 335/266, 267, 220, 268, 184, 181; 400/163.1, 163.2

[56] References Cited

U.S. PATENT DOCUMENTS

| | | | |
|---|---|---|---|
| 3,743,073 | 7/1973 | Perez | 400/163.2 |
| 3,745,497 | 7/1973 | Cavella | 335/266 |
| 3,952,853 | 4/1976 | Feldman | 400/163.1 |
| 3,977,320 | 8/1976 | Lupkas | 400/163.2 |

*Primary Examiner*—Harold Broome

*Attorney, Agent, or Firm*—Frederick P. Weidner; Bruce A. Yungman; Radford M. Reams

[57] ABSTRACT

A control mechanism for providing four separate linear control positions. Included is a lever having two ends, one end being free to register the four linear positions. First and second stationary solenoids both being located on one side of the lever are provided and the first solenoid plunger is pivotally secured to the lever at the end opposite the free end. The plunger of the second solenoid is pivotally secured to the lever between the ends of the lever. A stationary assembly including a spring is positioned and arranged to exert force on the lever between the first and second solenoids in a direction opposite the direction of solenoid plunger movement upon solenoid actuation. The spring force exerted on the lever is less than the combined force of the plungers of the first and second solenoids upon their common actuation. Separate spring force is exerted on the lever so that the lever is perpendicular to the plungers of the solenoids when both the first and second solenoids are deactuated.

9 Claims, 6 Drawing Figures

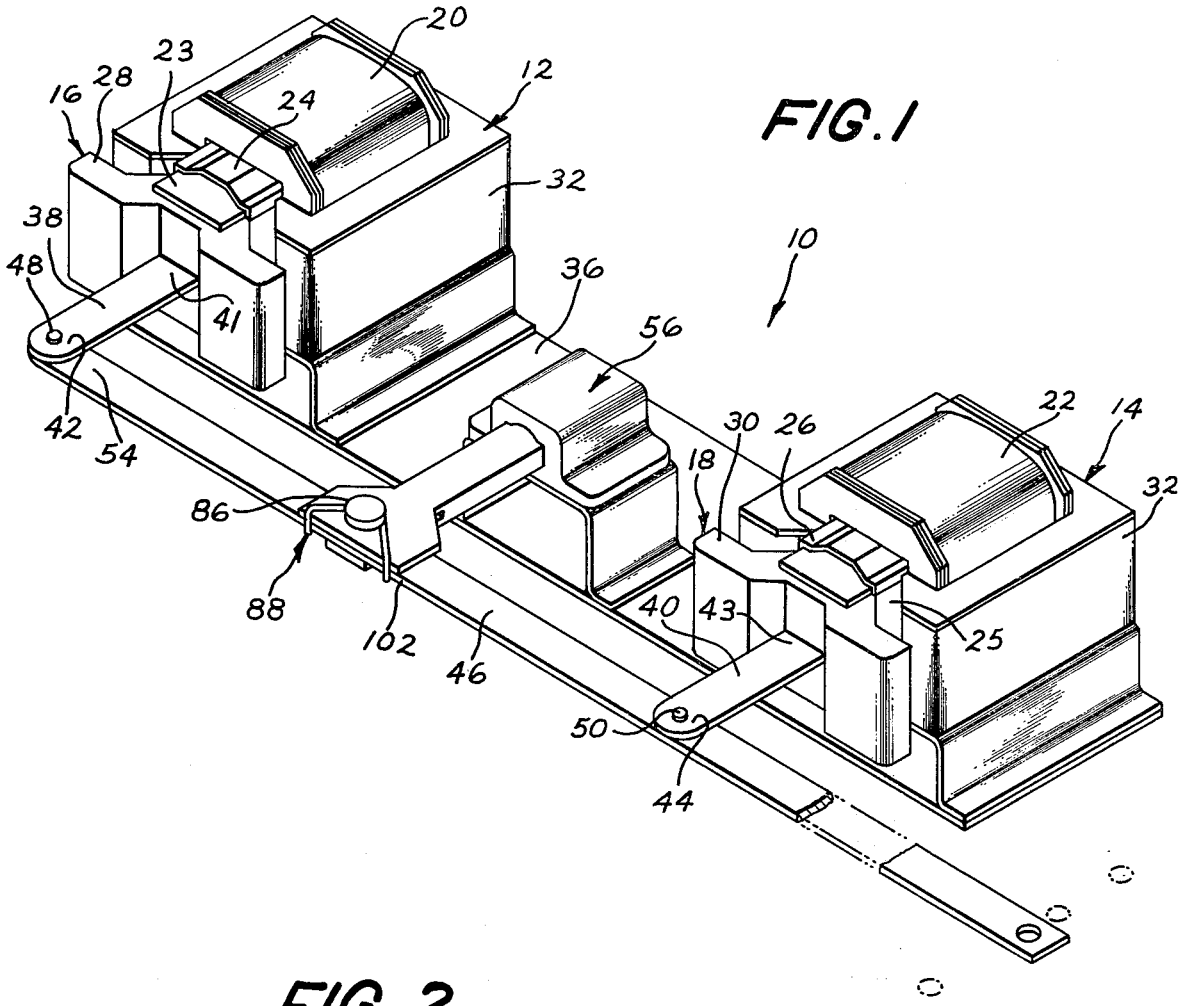
FIG. 1
FIG. 2
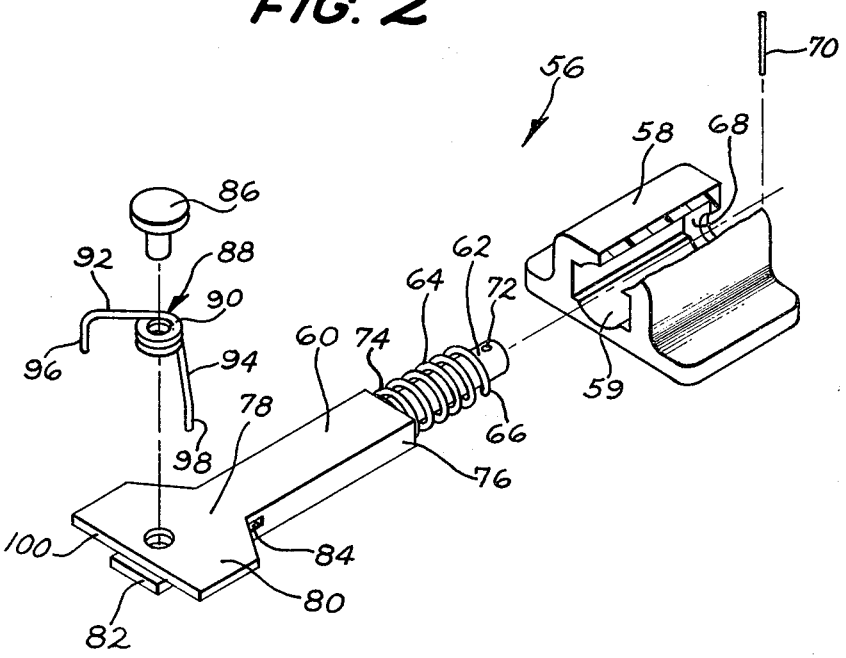

CONTROL MECHANISM

BACKGROUND OF THE INVENTION

This invention relates to control mechanisms, and more particularly to a control mechanism that provides four separate linear control positions.

Control mechanisms that will provide four separate linear control positions may be found useful in many applications. One such application may be in connection with automatic clothes washing machines wherein the sequence of operation of the machine ordinarily includes a presoak, a first liquid extraction operation, a wash operation, a second liquid extraction operation, a rinse operation, and a final extraction operation. It is desirable and found advantageous to introuce certain additives into the water or liquid used for a particular operation of a clothes washing machine. For instance, a prewash additive is normally used in a soak operation, a soap or detergent is normally used in a washing operation, a bleach is also often used in the washing operation, and rinse agents are added to the rinse water. A control mechanism that could be utilized for introducing the different additives at the proper time in the operation of the clothes washer machine would desirably provide for four different positions to dispense the four different additives.

By this invention there is a control mechanism for providing four separate linear control positions.

BRIEF SUMMARY OF THE INVENTION

There is provided a control mechanism that affords four separate linear control positions and includes a lever having two ends, one end being free to register the four linear positions. There are first and second stationary solenoids both being located on one side of the lever and each including a plunger within an electrically energized coil that produces a magnetic field, the plunger being movable responsive to actuation of the solenoid. The first solenoid plunger is pivotally secured to the lever at the end opposite the free end and the plunger of the second solenoid is pivotally secured to the lever between the ends thereof. There is a stationary assembly including a spring positioned and arranged to exert force on the lever between the first and second solenoid in a direction opposite the direction of plunger movement upon solenoid actuation. The spring force exerted on the lever is less than the combined force of the plungers of the first and second solenoids upon their common actuation. Means, which may be in the form of a spring, are provided to move the lever such that the lever is perpendicular to the plungers when both the first and second solenoids are deactuated.

BRIEF DESCRIPTION OF THE DRAWINGS

FIG. 1 is a perspective view of the control mechanism of the invention.

FIG. 2 is a fragmentary enlarged exploded perspective view of the stationary assembly of the control mechanism shown in FIG. 1.

DESCRIPTION OF THE PREFERRED EMBODIMENT

Figure 3:
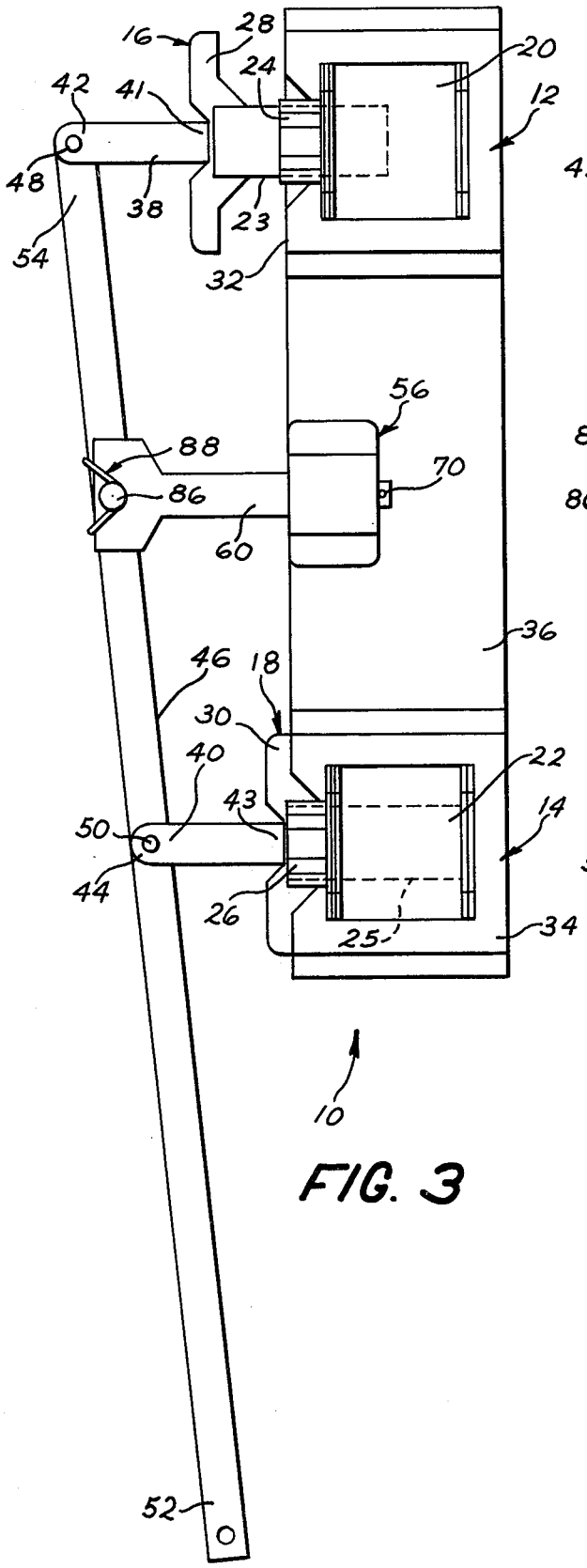
FIG. 3 is a top plan view of the control mechanism in the first position.
Figure 4:
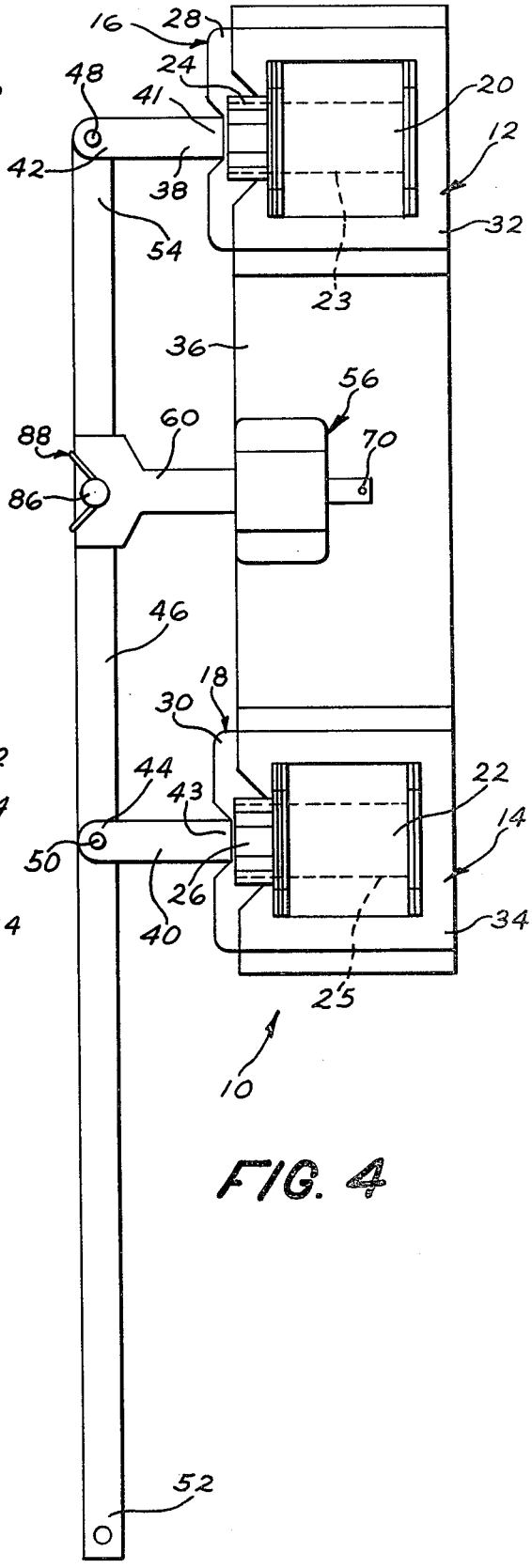
FIG. 4 is a top plan view of the control mechanism in the second position.

Referring to FIGS. 1 and 2, the control mechanism 10 includes a first solenoid 12 and a second solenoid 14. Electric solenoids are quite well known and have an electrically energized coil of insulated wire which produces a magnetic field within the coil. The magnetic field is used to magnetize and thus attract a plunger or armature to a position within the coil. Numerous solenoid configurations or types are commercially available and can be used in this control mechanism. The solenoids 12 and 14 shown in the drawings have T-shaped plungers 16 and 18 respectively. The plungers 16 and 18 are free to move in and out of coils 20 and 22 respectively with the bodies 23 and 25 of the plungers respectively being guided by a track 24 and 26 respectively. The plungers 16 and 18 have outwardly flared shoulders 28 and 30 respectively on both sides of the plunger and these shoulders will abut the solenoid body frames 32 and 34 respectively when the plunger is actuated and drawn into the center of the coils 20 and 22 respectively. This abutting will therefore limit the amount of inwardly directed travel of the plunger into the coils during actuation of the solenoids. Both solenoids 12 and 14 are secured to a base member 36 in spaced relationship.

The plungers 16 and 18 have extension members 38 and 40 respectively with one end 41 and 43 respectively secured to the plungers. The opposite ends 42 and 44 respectively of the extension members 38 and 40, are pivotally secured to a lever 46 as by pivot pin 48 for extension arm 36 and pivot pin 50 for extension arm 40. Lever 46 has a free end 52 which is free to register the four linear positions shown in FIG. 1 and which will be described in more detail later. The opposite end 54 of the lever 46 is pivotally secured to the first solenoid plunger 16 via extension member 38.

A stationary assembly 56 is also attached to base member 36 and is located between the two solenoids 12 and 14. The stationary assembly 56 is shown in FIG. 2 in an exploded perspective view so that the elements thereof may be easily seen. There is a housing member 58 with a cavity 59 for receiving therein a portion 62 of pivot arm 60. The portion 62 of the pivot arm 60 received in the cavity 59 of housing member 58 has around it a helical spring 64 which is also received in the cavity 59 of housing member 58. One end 66 of the spring 64 will abut the rear wall 68 of the housing member 58 and conveniently the pivot arm 60 will be retained in the housing member by a pin 70 through a hole 72 in the pivot arm portion 62. The opposite end 74 of the spring 64 will abut a portion 76 of the pivot arm 60. Thus the stationary assembly 56 is arranged and assembled such that spring 64 will be exerting force against the pivot arm 60 to urge it in a direction away from the housing member 58. The end portion 78 of the pivot arm 60 opposite the portion 62 is bifurcated and therefore has two legs 80 and 82 spaced vertically of each other. The space or slot 84 provided between the legs 80 and 82 receive therein the lever 46. The lever 46 is pivotally secured to the pivot arm 60 by means of a pin 86 through both the portion 78 of the pivot arm 60 and the lever 46. There is also provided means to move the lever such that the lever is perpendicular to the plungers 16 and 18 when both the first and second solenoids 12 and 14 are deactuated. One such means may be a spring which, in the case of the preferred embodiment, is a torsion spring 88 having a helical portion 90 and each end 92 and 94 respectively having depending legs 96 and 98. The legs 96 and 98 engage both the end 100 of the pivot arm 60 and one side 102 of the lever 46 such that when lever 46 pivots about pivot pin 86 the helical portion 90 of the spring is compressed. The spring 88 has sufficient force so that when the solenoids 12 and 14 are deactuated the spring force will cause the lever to center itself in a position perpendicular to the plungers 16 and 18. The stationary assembly as described above will by means of spring 64 exerting force against pivot arm 60 in turn exert force against the lever arm in a direction away from the stationary housing. The spring force exerted against the lever 46, however, is less than the combined force of the plungers 16 and 18 being drawn into the coils 20 and 22 of the first and second solenoids 12 and 14 upon their common actuation. That is, when both solenoids 12 and 14 are actuated the lever will be drawn toward the solenoids and the spring force exerted against the lever by spring 64 will be overcome.

With this control mechanism arrangement the first position of the free end 52 of the lever 46 is shown in FIG. 3 and is obtained by actuation of only the second solenoid 14 and the spring 64 exerts force against the lever 46 at the pivot point of the pivot arm 60 which acts as a fulcrum for the lever 46.

The second position of the free end 52 of the lever 46 is obtained by actuation of both solenoids 12 and 14 which because of their combined force being greater than the force exerted by spring 64 moves the lever 46 both at its free end 52 and at the opposite end 54 toward the solenoids and the pivot arm 60 of the stationary member is momved in a direction toward the housing member 58.

Figure 5:
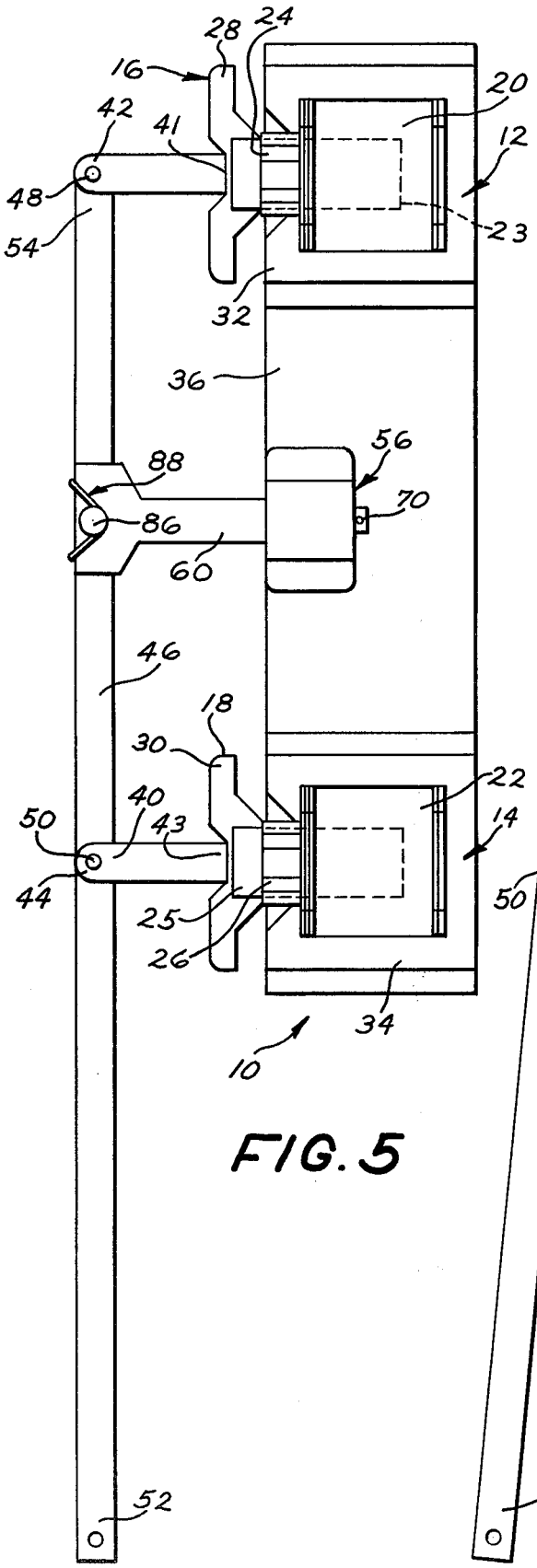
FIG. 5 is a top plan view of the control mechanism in the third position.

The third linear position of the free end 52 of the lever 46 is shown in FIG. 5 and is obtained by neither of the solenoids 12 and 14 being actuated thus the spring force applied to the lever by spring 64 moves the entire lever away from the solenoids 12 and 14.

Figure 6:
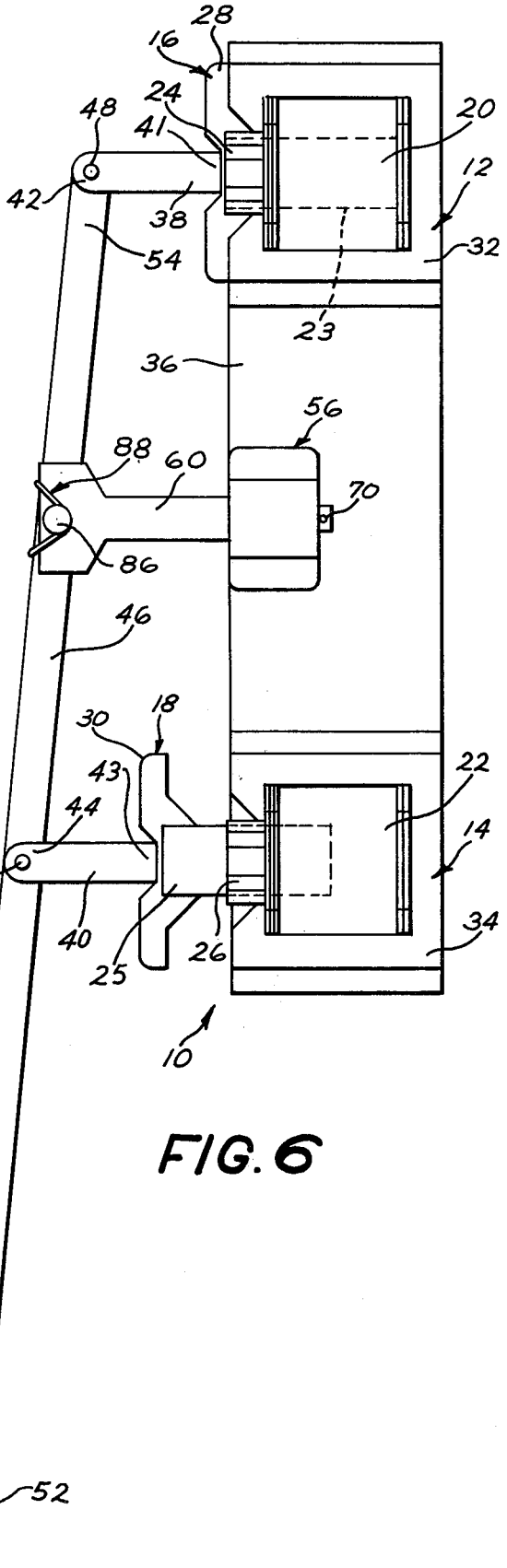
FIG. 6 is a top plan view of the control mechanism in the fourth position.

The fourth position of the free end 52 of the lever 46 is shown in FIG. 6 and is obtained by only the first solenoid 12 being actuated and the spring force of spring 64 exerts force against the lever 46 at the pivot point of the pivot arm 60 which acts as a fulcrum for lever 46.

The four positions of the free end 52 of the lever 46 may, of course, be varied by changing the length of the lever 46, the spacing of the solenoids 12 and 14 and also the location of the pivot point of the lever 46 provided by the pivot arm 60. It should be noted also that the spring 64 not only exerts force against the lever 46 in a direction opposite from the solenoids 12 and 14, but it also serves as a tolerance accumulator. That is, should the external load being moved by the lever 46 be great enough to stop the lever's movement of the free end 52 before the solenoid plunger is seated correctly in the coil, the spring 64 will be slightly compressed and take up any tolerance differences. This then will allow the plunger to be properly seated and prevent buzzing or possible burnout of the solenoid.

The foregoing is a description of the preferred embodiment of the invention and it should be understood that variations may be made thereto without departing from the true spirit of the invention, as defined in the appended claims.

What is claimed is:

1. A control mechanism for providing four separate linear control positions comprising:

a lever having two ends, one end being free to register the four linear positions, first and second stationary solenoids both being located on one side of the lever and each including a plunger within an electrically energized coil that produces a magnetic field, the plunger being movable responsive to actuation of the solenoid, said first solenoid plunger being pivotably secured to the lever at the end thereof opposite the free end and the plunger of the second solenoid being pivotably secured to the lever between the ends thereof, and a stationary assembly including a spring positioned and arranged to exert force on the lever between the first and second solenoid in a direction opposite the direction of plunger movement upon solenoid actuation, said spring force exerted on the lever being less than the combined force of the plungers of the first and second solenoids upon their common actuation, and means to move the lever such that the lever is perpendicular to the plungers when both the first and second solenoids are deactuated.

2. The control mechanism of claim 1 wherein the spring of the stationary assembly is a compression spring and the stationary assembly is located on the same side of the lever as the solenoids.

3. The control mechanism of claim 1 wherein the first and second solenoids have T-shaped plungers that are moved inwardly of the coil when the solenoid is actuated.

4. The control mechanism of claim 1 wherein the means to move the lever such that the lever is perpendicular to the plungers when both the first and second solenoids are deactuated is a spring.

5. The control mechanism of claim 1 wherein the stationary assembly includes a pivot arm about which the lever may pivot.

6. The control mechanism of claim 5 wherein the stationary assembly includes a pivot pin about which the lever may pivot and is through the pivot arm and lever.

7. The control mechanism of claim 5 wherein the pivot arm has a bifurcated end portion providing spaced legs with the lever received therebetween.

8. The control mechanism of claim 5 wherein the spring of the stationary assembly positioned and arranged to exert force on the lever is a helical spring one end of which is immovable axially and the other end exerts force on the pivot arm.

9. The control mechanism of claim 8 wherein the pivot arm of the stationary assembly has a portion received axially through the helical spring.

* * * * *